US007227561B2

(12) United States Patent
Doyen et al.

(10) Patent No.: US 7,227,561 B2
(45) Date of Patent: Jun. 5, 2007

(54) METHOD OF DISPLAYING VIDEO IMAGES ON A DISPLAY DEVICE, E.G. A PLASMA DISPLAY PANEL

(75) Inventors: Didier Doyen, La Bouexière (FR); Jonathan Kervec, Paimpont (FR); Herert Hoelzemann, Merkelbach (DE)

(73) Assignee: Thomson Licensing, Boulogne-Billancourt (FR)

( * ) Notice: Subject to any disclaimer, the term of this patent is extended or adjusted under 35 U.S.C. 154(b) by 56 days.

(21) Appl. No.: 10/488,919

(22) PCT Filed: Aug. 22, 2002

(86) PCT No.: PCT/EP02/09479

§ 371 (c)(1),
(2), (4) Date: Oct. 5, 2004

(87) PCT Pub. No.: WO03/023151

PCT Pub. Date: May 20, 2003

(65) Prior Publication Data

US 2005/0052351 A1 Mar. 10, 2005

(30) Foreign Application Priority Data

Sep. 5, 2001 (FR) ..... 01 11641

(51) Int. Cl.
*G09G 5/10* (2006.01)

(52) U.S. Cl. ..... 345/691; 345/63

(58) Field of Classification Search ..... 345/63, 345/89, 690–693

See application file for complete search history.

(56) References Cited

U.S. PATENT DOCUMENTS

| | | | | |
|---|---|---|---|---|
| 5,619,228 | A * | 4/1997 | Doherty | 345/693 |
| 5,986,640 | A | 11/1999 | Baldwin et al. | 345/147 |
| 6,014,258 | A * | 1/2000 | Naka et al. | 359/618 |
| 6,052,112 | A * | 4/2000 | Tanaka et al. | 345/596 |
| 6,097,358 | A * | 8/2000 | Hirakawa et al. | 345/63 |
| 6,144,364 | A | 11/2000 | Otobe et al. | 345/147 |
| 6,175,194 | B1 | 1/2001 | Saegusa et al. | 315/169.4 |
| 6,208,467 | B1 * | 3/2001 | Naka et al. | 359/618 |
| 6,552,701 | B1 * | 4/2003 | Tanaka | 345/63 |

FOREIGN PATENT DOCUMENTS

| | | |
|---|---|---|
| EP | 0698874 | 2/1996 |
| EP | 0978817 | 2/2000 |

* cited by examiner

*Primary Examiner*—Amr A. Awad
*Assistant Examiner*—Tom Sheng
(74) *Attorney, Agent, or Firm*—Joseph J. Lake; Harvey D. Fried; Patricia Verlangieri

(57) ABSTRACT

The present invention relates to a method of displaying video images on a display device and especially on a plasma display panel. The frame for displaying a video image is divided into two subframes, both comprising approximately the same number of subscans. The subscans of the first subframe are arranged in a first order in which their weights increase and those of the second subframe in the reverse order. The second subframe is consecutive to the first subframe. Each cell of the PDP changes state at most once during the first subframe. The same applies during the second subframe.

9 Claims, 12 Drawing Sheets

METHOD OF DISPLAYING VIDEO IMAGES ON A DISPLAY DEVICE, E.G. A PLASMA DISPLAY PANEL

This application claims the benefit, under 35 U.S.C. § 365 of International Application PCT/EP02/09479, filed Aug. 22, 2002, which was published in accordance with PCT Article 21(2) on Mar. 20, 2003 in English and which claims the benefit of French patent application No. 0111641, filed Sep. 5, 2001.

The present invention relates to a method of displaying video images on a display device. The invention is particularly applicable to plasma display panels (PDPs) comprising a matrix of elementary cells which may either be in the on state or in the off state.

PDP technology allows large flat display screens to be obtained. PDPs generally comprise two insulating tiles defining between them a gas-filled space in which elementary: spaces bounded by barriers are defined. Each tile is provided with one or more arrays of electrodes. An elementary cell corresponds to an elementary space which is provided, on each side of the said elementary space, with at least one electrode. To activate an elementary cell, an electrical discharge is produced in the corresponding elementary space by applying a voltage between the electrodes of the cell. The electrical discharge then causes the emission of UV rays in the elementary cell. Phosphors deposited on the walls of the cell convert the UV rays into visible light.

The operating period of an elementary cell of a PDP coincides with the display period of a video image, called a video frame. Each video frame is composed of several elementary periods commonly called subscans. Each subscan comprises an address period, a sustained period and an erased period. Turning on or addressing a cell consists in sending an electrical pulse of large amplitude in order to place the cell in the on state. The cell is maintained in the on state by sending a succession of smaller pulses during the sustained period. Each subscan has a specific sustained period duration and a weight which is a function of the duration of its sustained period. The cell is erased or turned off by cancelling the electrical charges inside the cell by means of a damped discharge. The illumination periods of the cell correspond to the sustained periods of the cell. These periods are distributed over the entire video frame. The human eye then performs an integration of these illumination periods in order to recreate the corresponding grey level.

There are a few problems associated with the temporal integration of the illumination periods. A contouring problem occurs when two neighbouring regions in the video image have very similar grey levels with uncorrelated illumination periods and when the transition between these two regions moves over several images. This contouring problem is illustrated by FIG. 1, which shows the subscans for two consecutive images, I and I+1, having two neighbouring regions with a grey level of 127 and a grey level of 128 respectively. Each video frame comprises eight subscans of respective weights 1, 2, 4, 8, 16, 32, 64 and 128. The transition between these two regions moves by 4 pixels between the image I and the image I+1. In this figure, the y-axis represents the time axis and the x-axis represents the pixels of the various images. The integration performed by the eye amounts to integration over time along the oblique lines shown in the figure, since the eye has a tendency to follow the moving object. It therefore integrates the information coming from different pixels. The result of the integration is manifested by the appearance of a grey level equal to zero at the moment of the transition between the grey levels 127 and 128. This passage through the zero grey level makes a dark band appear at the transition. Conversely, if the transition passes from the level 128 to the level 127, a level 255 corresponding to a light band appears at the moment of the transition.

A first solution to this problem consists in "breaking" the high-weight subscans in order to reduce the integration error. For example, the subscans of weights 64 and 128 may be replaced with six subscans of weight 32. The maximum integration error then has a grey level of 32. It is also possible to distribute the grey levels differently, but there is always an integration error.

Another solution to this problem, given in European Patent Application No. 0 978 817, consists in anticipating this integration by the eye, by shifting the subscans in the direction of movement so that the eye integrates the correct information. This technique uses a movement estimator to calculate a movement vector for each pixel of the image to be displayed. These movement vectors are used to modify the data delivered to the elementary cells of the PDP. This technique is illustrated by FIG. 2. In this figure, each video frame comprises twelve subscans of respective weights 1, 2, 4, 8, 16, 32, 32, 32, 32, 32, 32 and 32. As mentioned previously, the correction consists in displacing the subscans spatially according to the observed movements between the images so as to anticipate the integration that the human eye will perform. The subscans are displaced differently according to their weight and to their temporal position in the video frame. This correction gives excellent results on the transitions which cause contouring effects. However, this movement compensation correction poses a few problems as regards the movement vectors to be applied when objects appear or disappear between two images.

Another solution consists in using what is referred to as "incremental" encoding of the grey levels. With this encoding, the cells of the PDP change state at most once during the video frame. For example, if a cell is in the off state at the start of the video frame and then passes to the on state, it remains in this state until the end of the frame. The main drawback with this encoding is the very restricted number of grey levels that can be displayed by a cell. FIG. 3 shows the grey levels that can be displayed with incremental encoding in the case of a video frame comprising twelve subscans of respective weights 1, 2, 4, 8, 16, 32, 32, 32, 32, 32, 32 and 32. In this example, it is possible to display thirteen different grey levels, namely the levels 0, 1, 3, 7, 15, 31, 63, 95, 127, 159, 191, 223 and 255. In this figure, the subscans are arranged in decreasing order of their weights in order to obtain several low-value grey levels (namely the levels 0, 1, 3, 7, 15 and 31). The fact that the "on" subscans (the subscans during which the cell is in the on state) for a given grey level are also "on" for the higher grey levels and that there is no "off" subscan (a subscan during which the cell is in the off state) between two "on" subscans in the same video frame makes it possible to avoid the contouring effects, namely the appearance of a lighter or darker band at the transition between two neighbouring regions having similar grey levels. Dithering techniques, well known to those skilled in the art, are used to partly compensate for the small number of grey levels of the incremental code. The principle of the dithering technique consists in decomposing the desired grey level into a combination of displayable grey levels which, by temporal integration (these grey levels are displayed on several successive images) and/or by spatial integration (these grey levels are displayed in a region of the image encompassing the pixel in question), reproduce on the screen a grey level similar to the desired grey level. However, it is desirable to have a larger number of displayable grey levels with incremental encoding for displaying the video images.

The invention provides another encoding of the grey levels in order to correct the contouring effects. The invention is a method of displaying a video image on a display device, comprising a plurality of elementary cells, during a display frame, the display frame of a video image being composed of a plurality of periods called subscans during which each elementary cell is either in the on state or in the off state, each subscan having a weight proportional to its illumination period. Each display frame is divided into first and second subframes during which each cell changes state at most once, the said first and second subframes comprising approximately the same number of subscans, the subscans of the first subframe being arranged in a first order in which their weights increase and the subscans of the second subframe being arranged in a second order in which their weights decrease, the second order being the reverse of the first order.

Preferably, for each cell, the first and second subframes comprise approximately the same number of subscans during which the said cell is in the on state.

The first and second subframes may or may not comprise the same number of subscans and the weights of the subscans of the second subframe may or may not be different from those of the first subframe.

In a first embodiment, when the first subframe comprises N subscans during which the cell is in the on state, the second subframe comprises N−1 or N of them, N being a natural integer greater than or equal to 1. In this embodiment, all the "on" subscans for a given grey level are also on for the higher grey levels. There is therefore no contouring problem.

In a second embodiment, when the first subframe comprises N subscans during which the cell is in the on state, the second subframe comprises N−1, N or N+1 of them, N being a natural integer greater than or equal to 1.

In a third embodiment, when the first subframe comprises N subscans during which the cell is in the on state, the second subframe comprises N−2, N−1, N, N+1 or N+2 of them, N then being a natural integer greater than or equal to 2.

In these last two embodiments, the "on" subscans for a given grey level are not necessarily on for the higher grey levels. These two embodiments reduce the contouring effects without completely eliminating them, but do allow a larger number of grey levels to be obtained.

To reduce these contouring effects, it is advantageous to compensate for the movement of the subscans of the second subframe. To do this, the movement of the current video image with respect to the preceding video image is estimated so as to generate a movement vector for each pixel of the video image and, for each pixel of the current video image, the subscans of the second subframe are displaced by an amount equal to half of the movement vector generated.

Finally, the invention also relates to a plasma display panel comprising a device that implements the display method of the invention.

Further features and advantages of the invention will become apparent on reading the detailed description which follows and which is given with reference to the appended drawings, in which.

According to the invention, the display frame of a video image is divided into two subframes, both comprising approximately the same number of subscans. The subscans of the first subframe are arranged in increasing order of their weights and those of the second subframe in the reverse order. The second subframe is consecutive with the first subframe. Each cell of the PDP changes state at most once during the first subframe, the change of state corresponding to it being turned on. Each cell of the PDP changes state at most once during the second subframe, the change of state corresponding to the cells being turned off. The first and second subframes comprise, for each cell, approximately the same number of subscans during which the cell in question is in the on state.

Figure 1:
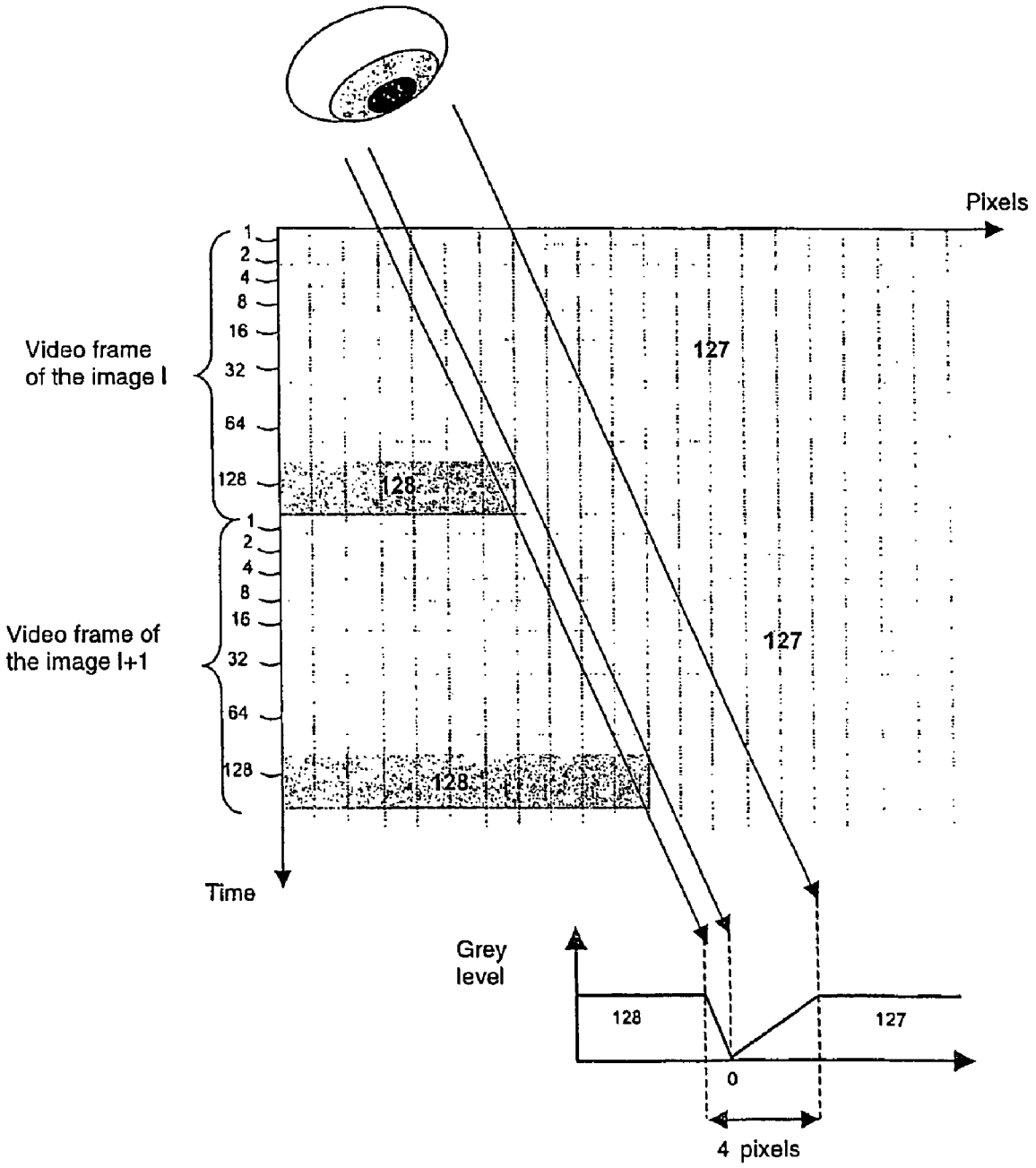
FIG. 1 illustrates the contouring effects that appear when a transition moves between two consecutive images.
Figure 2:
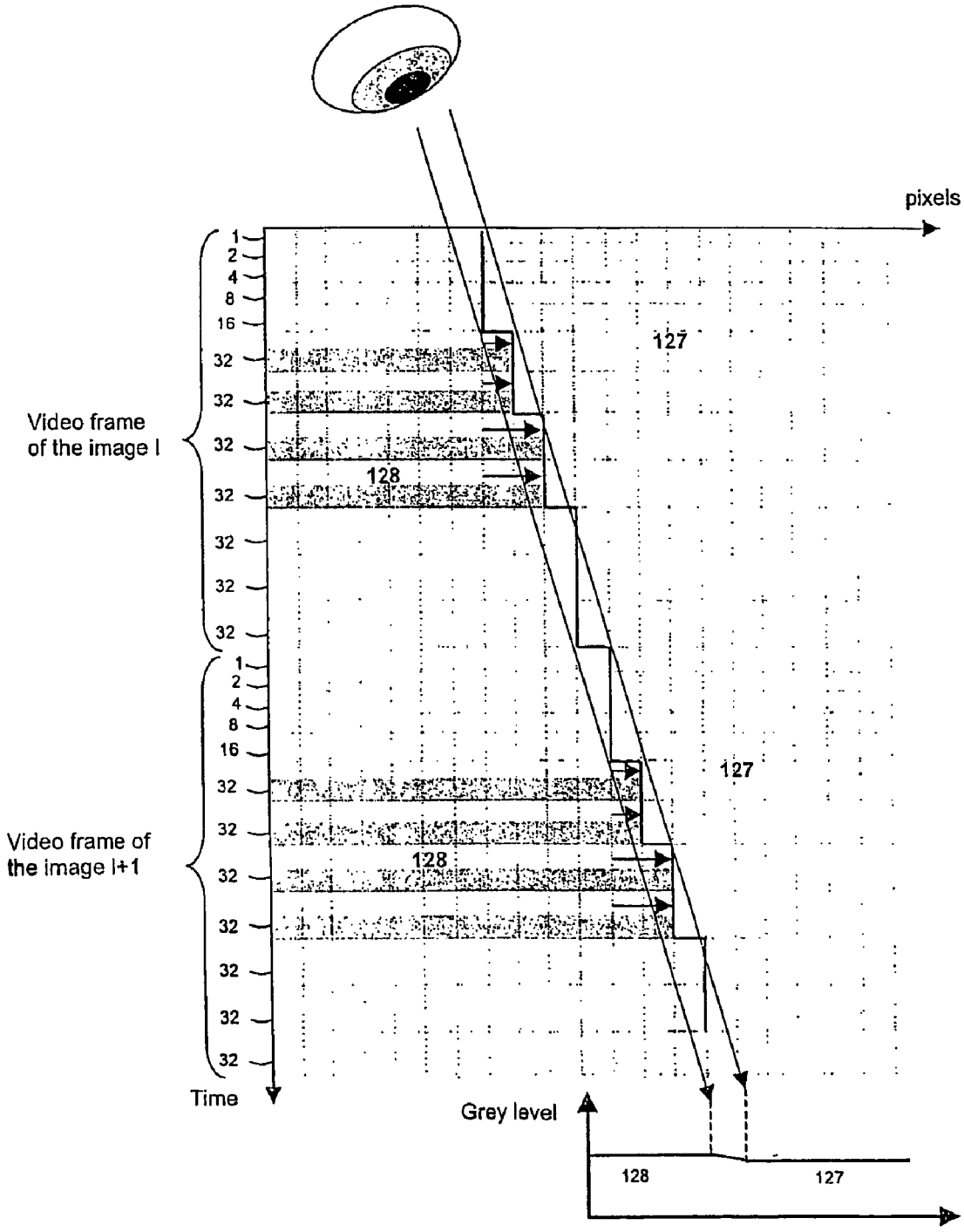
FIG. 2 illustrates a known solution to this problem, consisting in displacing the subscans in the direction of movement.
Figure 3:
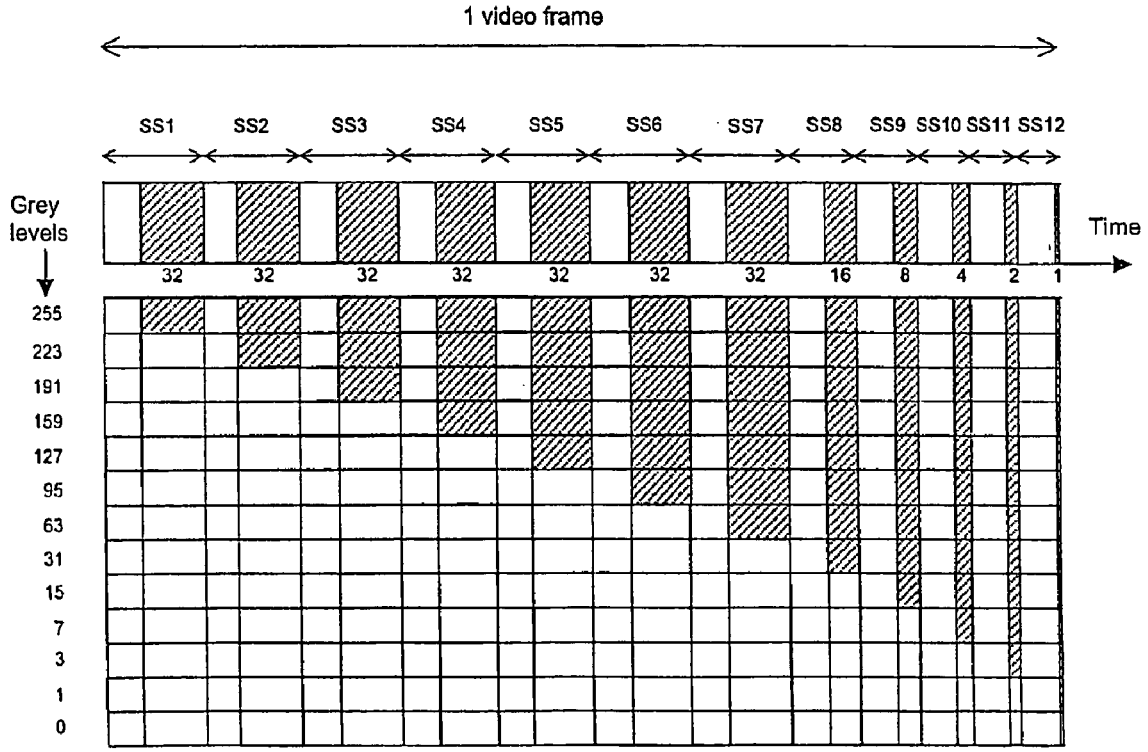
FIG. 3 shows the various grey levels that can be displayed with an incremental code in the case of a video frame comprising twelve subscans.
Figure 4:
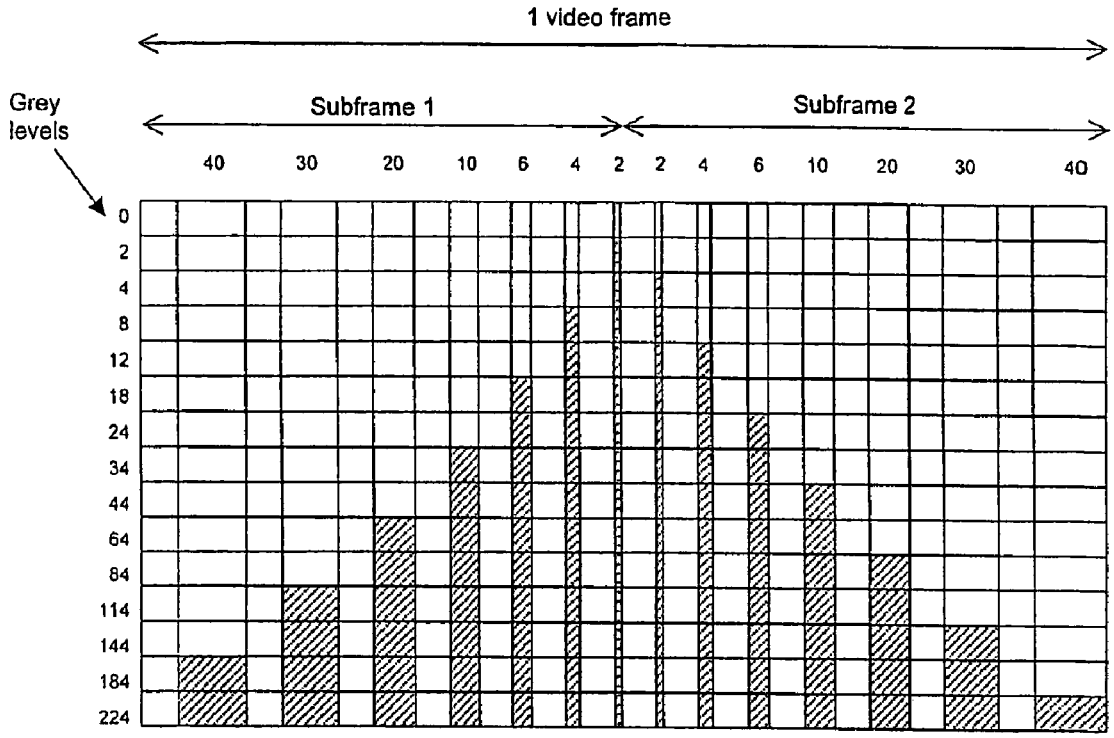
FIG. 4 shows the various grey levels that can be displayed with encoding according to a first embodiment of the invention.

FIG. 4 illustrates a first embodiment of the method of the invention, in which, when the first subframe comprises N "on" subframes, the second subframe comprises N−1 or N of them, N being a natural integer greater than or equal to 1. In a variant, the second subframe may comprise N or N+1 of them instead of N−1 or N, N then being a natural integer greater than or equal to zero.

FIG. 4 shows the various grey levels that can be displayed with this embodiment for a video frame comprising fourteen subscans. In this embodiment, all the subscans which are "on" for a given grey level are also on for the higher grey levels. The first and second subframes each comprise seven subscans of respective weights 2, 4, 6, 10, 20, 30 and 40. The subscans are arranged in increasing order of their weights in the first subframe and in decreasing order in the second subframe. The method of the invention makes it possible, in this example, to display fifteen different grey levels, namely the levels 0, 2, 4, 8, 12, 18, 24, 34, 44, 64, 84, 114, 144, 184 and 244. A grey level 0 is obtained when all the subscans of the two subframes are "off". The grey level 2 is obtained by "turning on" the subscan of weight 2 of the first subframe. The grey level 4 is obtained by "turning on" the subscan of weight 2 of the first and second subframes. The grey level 8 is obtained by "turning on" the subscans of weights 2 and 4 of the first subframe and the subscan of weight 2 of the second subframe. The grey level 12 is obtained by "turning on" the subscan of weights 2 and 4 of the first and second subframes, and so on.

In the example in FIG. 4, the code is symmetrical in terms of the weights of the subscans and the various consecutive grey levels form a pyramid if the subscans are considered to be "on" during the video frame. Each cell is on during the first subframe and off during the second subframe. There are no "off" subscans between two "on" subscans. There is therefore no contouring problem.

However, the number of different grey levels that can be displayed with this first embodiment remains rather restricted and is identical to that of the incremental encoding of the prior art.

This is why a second embodiment has been proposed which provides a larger spread of displayable grey levels. In this embodiment, the second subframe comprises N−1, N or N+1 "on" subscans when the first subframe comprises N of them, N being a natural integer greater than or equal to 1.

Figure 5:
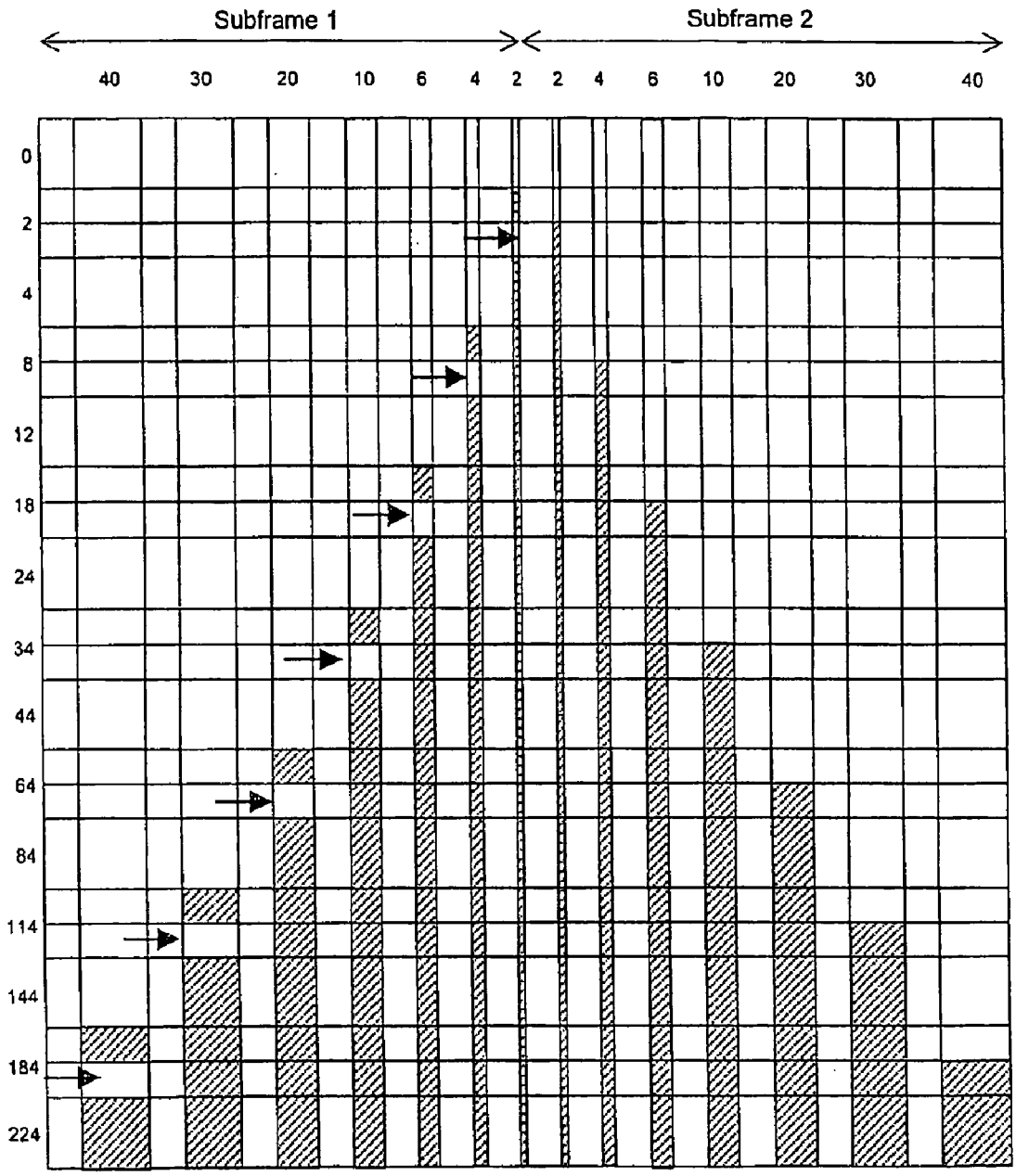
FIGS. 5 to 7 show the various grey levels that can be displayed with encoding according to a second embodiment of the invention.
Figure 6:
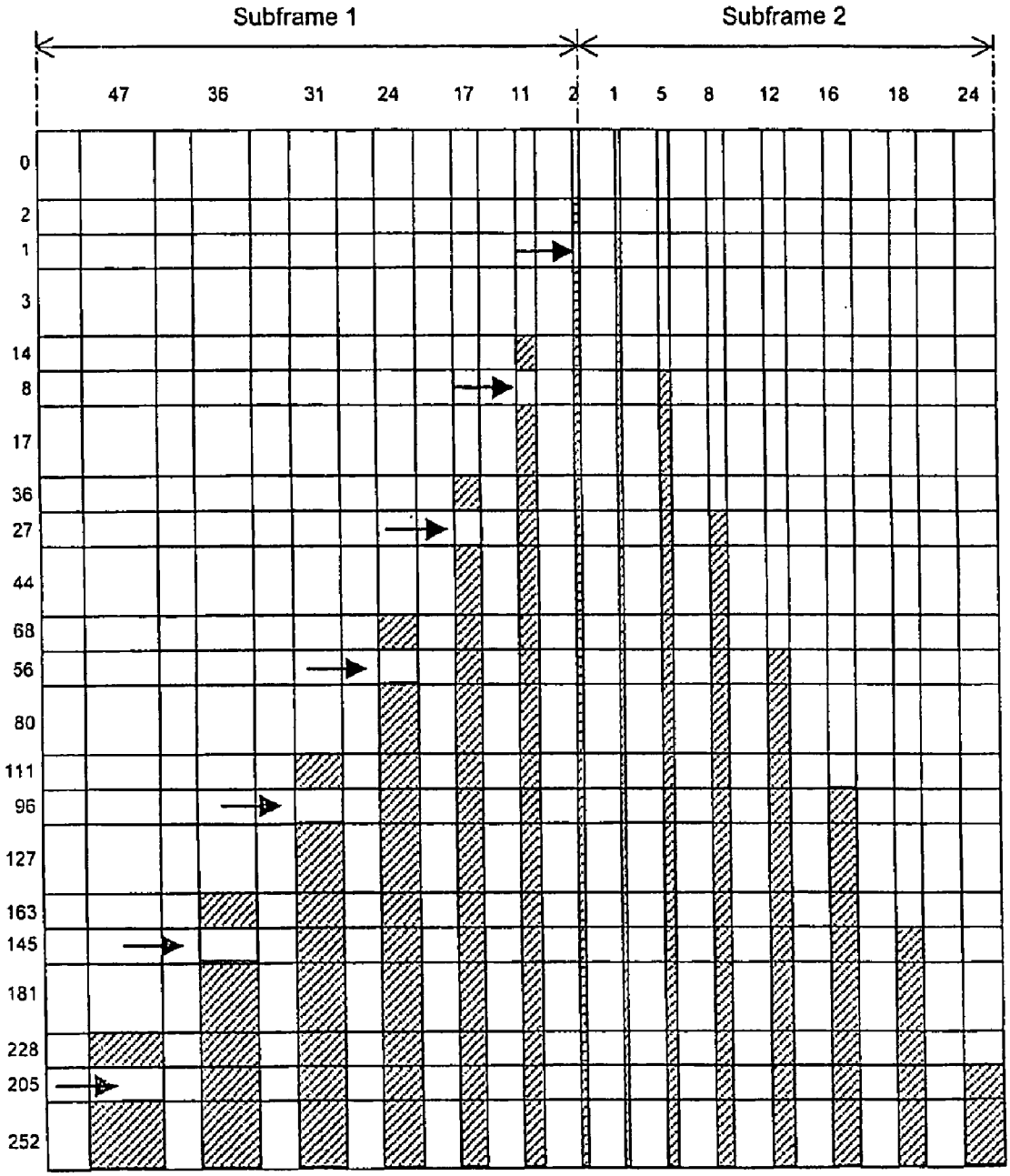
Figure 7:
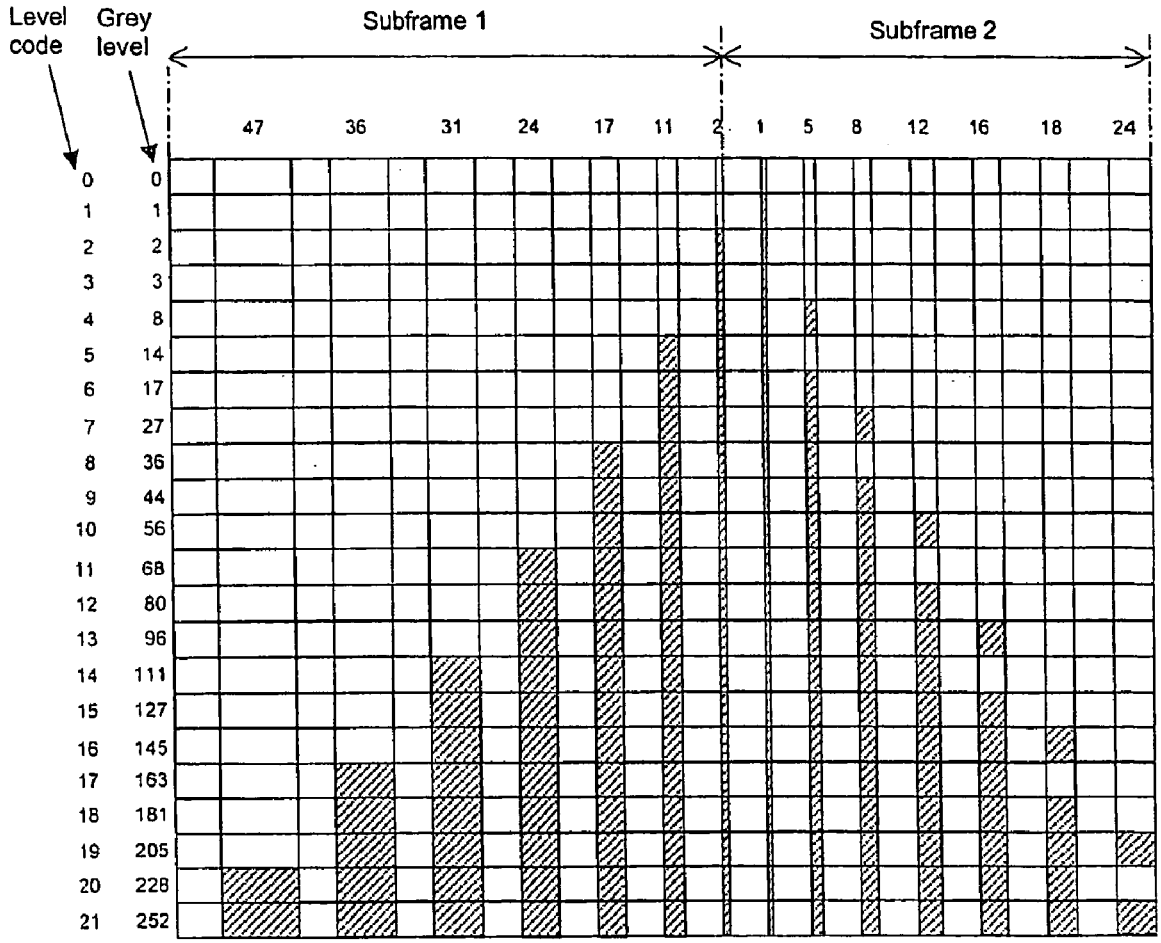

This embodiment is illustrated by FIGS. 5 to 7. In this second embodiment, the subscans which are "on" for a given grey level are not necessarily on for the higher grey levels. The grey levels that can be displayed with this second embodiment are:

- the grey levels that can be displayed with the first embodiment; and
- the grey levels obtained by shifting from a subscan the turning-on of the subscans of the grey levels of the first embodiment which comprise an odd number of subscans.

FIG. 5 shows the grey levels that can be displayed with this embodiment. Additional grey levels are created by shifting towards the right the turning-on of the subscans of the grey levels 2, 8, 18, 34, 64, 114 and 184 of FIG. 4. This second embodiment is only of little interest when the video frame is symmetrical in terms of the subscan weights (the case in FIG. 5) as the new grey levels created already exist.

On the other hand, if the weights of the subscans of the second subframe are changed and made different from those of the first subframe, as illustrated in FIG. 6, then seven new grey levels are obtained. In the example in FIG. 6, the first subframe comprises seven subscans of respective weights 47, 36, 31, 24, 17, 11 and 2 and the second subframe seven subscans of respective weights 1, 5, 8, 12, 16, 18, 24. Twenty-two grey levels are therefore obtained, namely the levels 0, 1, 2, 3, 8, 14, 17, 27, 36, 44, 56, 68, 80, 96, 111, 127, 145, 163, 181, 205, 228 and 252, i.e. a gain of 50% with regard to the non-zero grey levels (twenty-one instead of fourteen) in relation to the first embodiment. FIG. 7 shows the grey levels of FIG. 6 ordered from the lowest to the highest from the top down in the figure.

In this embodiment, two consecutive grey levels have at most two subscans whose state is different for a given cell of the PDP and also have, to within one unit, the same number of "on" subscans. The fact that all the subscans which are "on" for a given grey level are not necessarily on for the higher grey levels introduces limited contouring effects. On the other hand, the number of displayable grey levels is substantially increased.

In the future, this display method may perhaps allow the display circuit of the PDP to be simplified, requiring only a single operation to turn on the cells and a single operation to erase them during a video frame. At the present time, it is still necessary to turn the cell on and off at each subframe.

Figure 8:
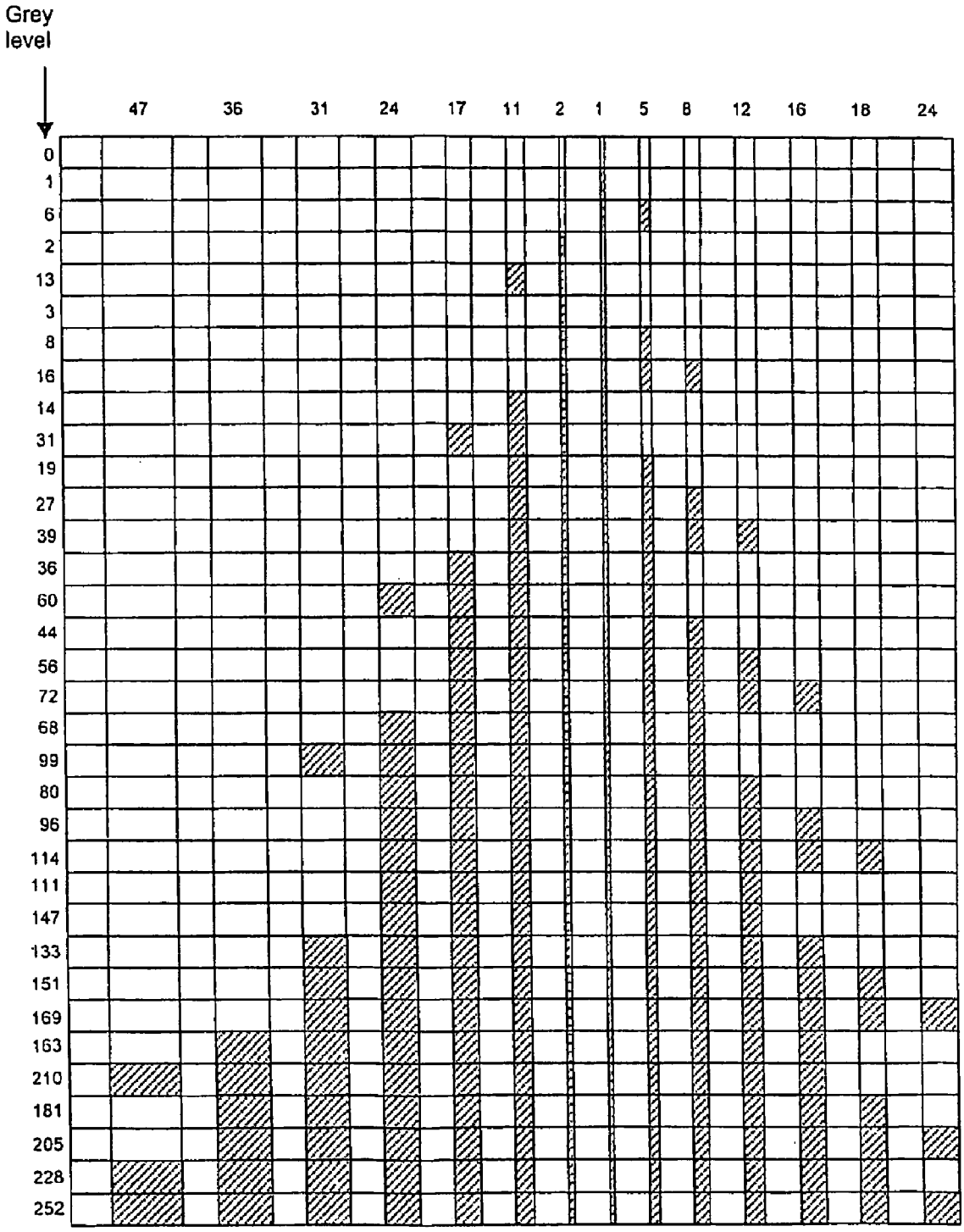
FIG. 8 shows the various grey levels that can be displayed with encoding according to a third embodiment of the invention.

According to a third embodiment, illustrated in FIG. 8, the second subframe comprises N−2, N−1, N, N+1 or N+2 "on" subscans when the first subframe comprises N of them, N being a natural integer greater than or equal to 2. In this embodiment, two consecutive grey levels have at most three subscans whose state is different for a given cell of the PDP. This embodiment makes it possible to increase by 135% the number of non-zero displayable grey levels (thirty-three instead of fourteen) with fourteen subscans compared with the first embodiment. In this example, the subscans of the first and second subframes are identical to those in FIGS. 6 and 7. Thirty-four grey levels are obtained, namely the levels 0, 1, 2, 3, 6, 8, 13, 14, 16, 19, 27, 31, 36, 39, 44, 56, 60, 68, 72, 80, 96, 99, 111, 114, 133, 147, 151, 163, 169, 181, 205, 210, 228 and 252. This embodiment allows the number of possible grey levels to be increased further, but it also introduces slightly more contouring effects than the second embodiment.

Figure 9:
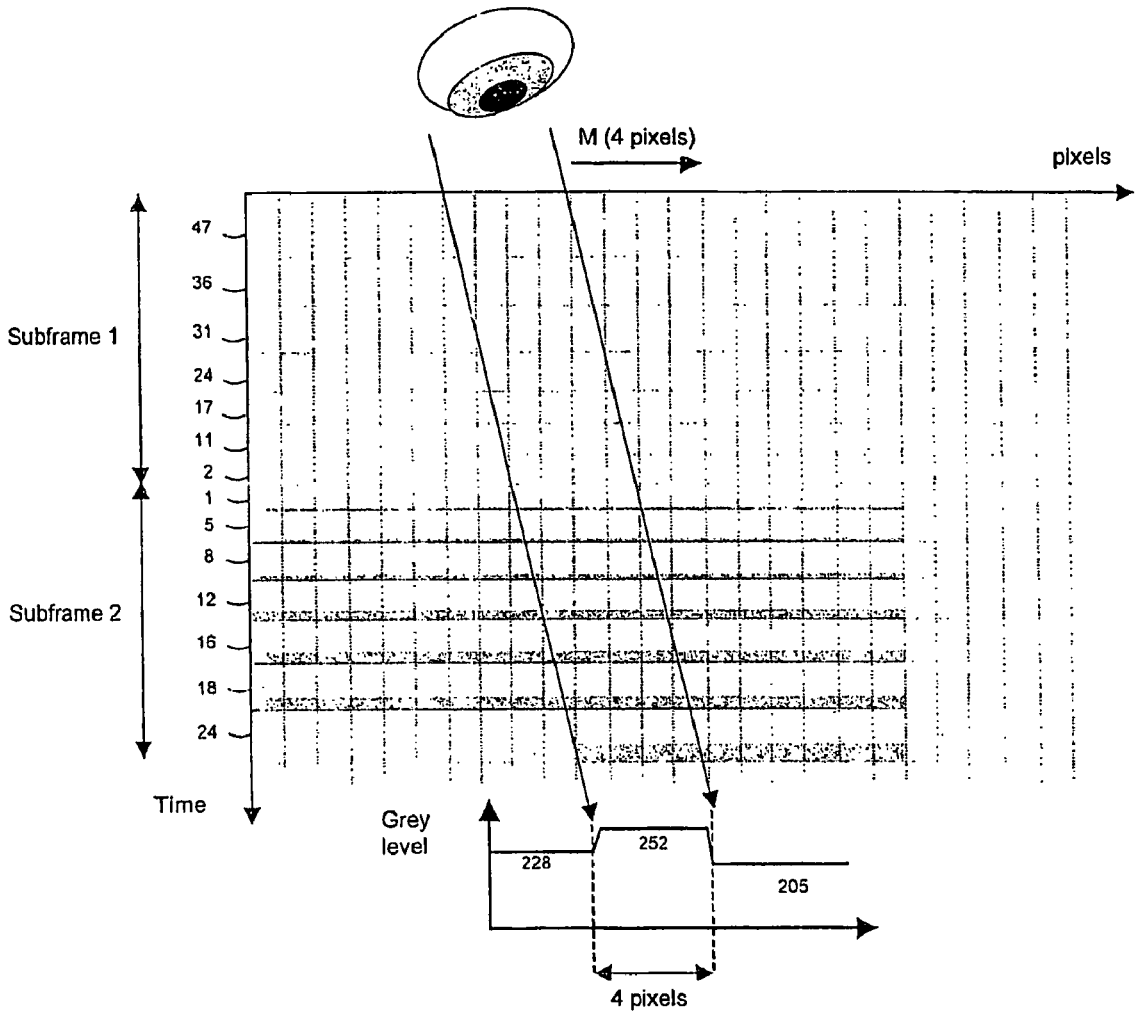
FIG. 9 shows a transition between a grey level of 228 and a grey level of 169, displayed according to the third embodiment of the invention without the subscans being shifted in the direction of movement.

As indicated above, the second and third embodiments introduce contouring effects. FIG. 9 shows a transition between a grey level of 228 and a grey level of 205 moving by 4 pixels, the two grey levels being displayed according to the third embodiment. A grey level of 252 (lighter band) appears at the transition. However, this contouring is limited in relation to the amplitude of the grey levels in question. Provision may then be made to shift the subscans in the direction of movement in order to partly correct this.

To accomplish this, a movement vector M is calculated for each pixel of the image to be displayed, the movement vector representing the movement of the said pixel in the image in question with respect to the preceding image, and the subscans of the second subframe are displaced by an amount approximately equal to half of the calculated movement vector, i.e. M/2, in the direction of movement. In the case of FIG. 9, M is equal to four pixels. This movement vector is calculated by a conventional movement estimator.

Figure 10:
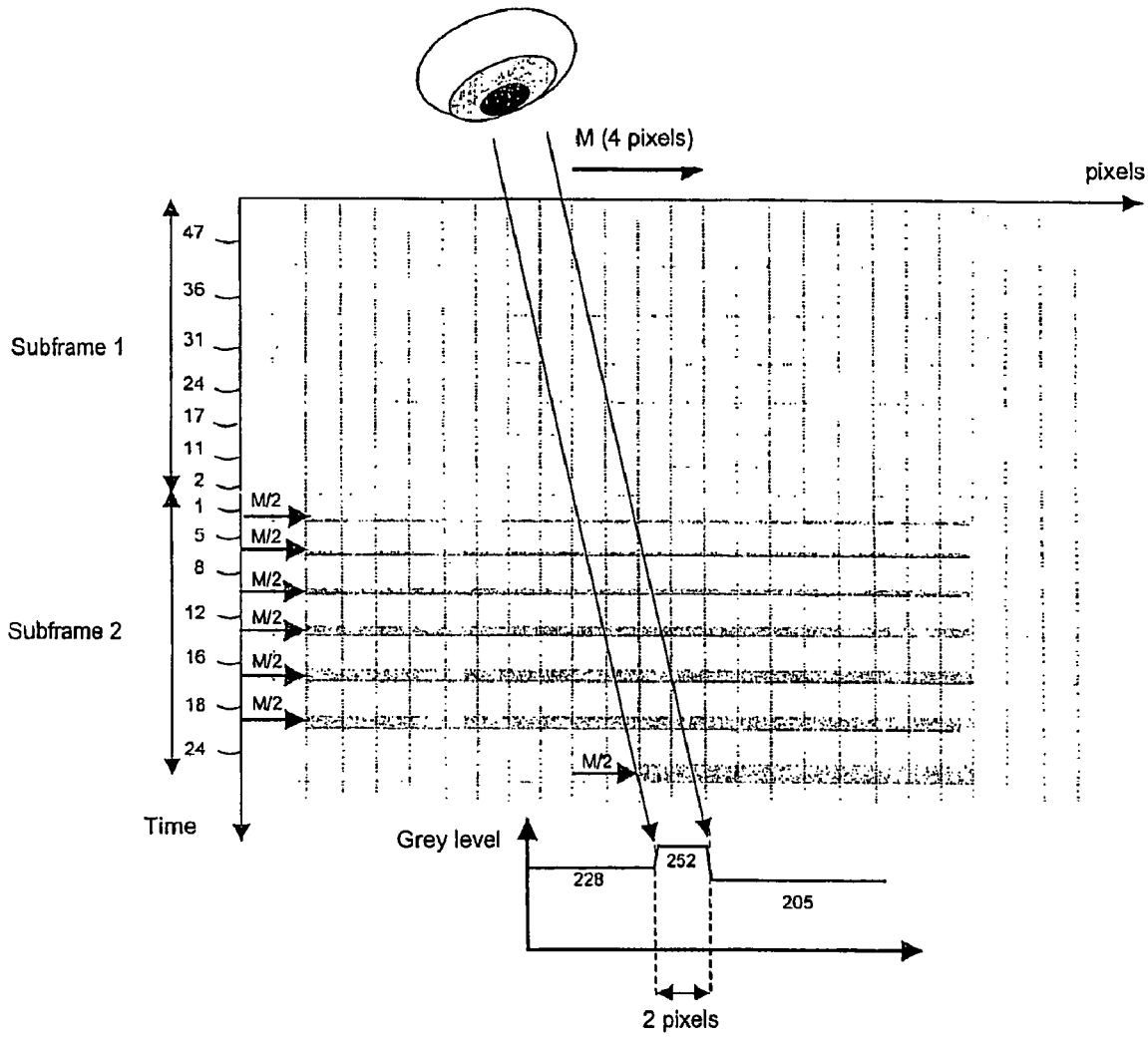
FIG. 10 shows the transition of FIG. 9 with the subscans of the second subframe shifted in the direction of movement.

FIG. 10 shows the displacement of the subscans of the second subframe by M/2 (=2) pixels in the direction of movement. The temporal integration in the direction of movement always makes the grey level 252 appear at the transition, but this integration error concerns only two pixels instead of four pixels without movement compensation (FIG. 9). The displacement of the subscans of the second subframe in the direction of movement therefore allows the contouring effects to be reduced.

The grey levels that can be displayed according to one of the embodiments of the method of the invention may also be advantageously used to make a gamma correction of the video signal delivered to the PDP. This correction is illustrated by considering the twenty-two grey levels obtained in FIG. 7. A level code is associated with each of these twenty-two grey levels, the codes 0 to 21 being associated with the displayable grey levels 0 to 252 of the second embodiment respectively, as shown in FIG. 7.

Figure 11:
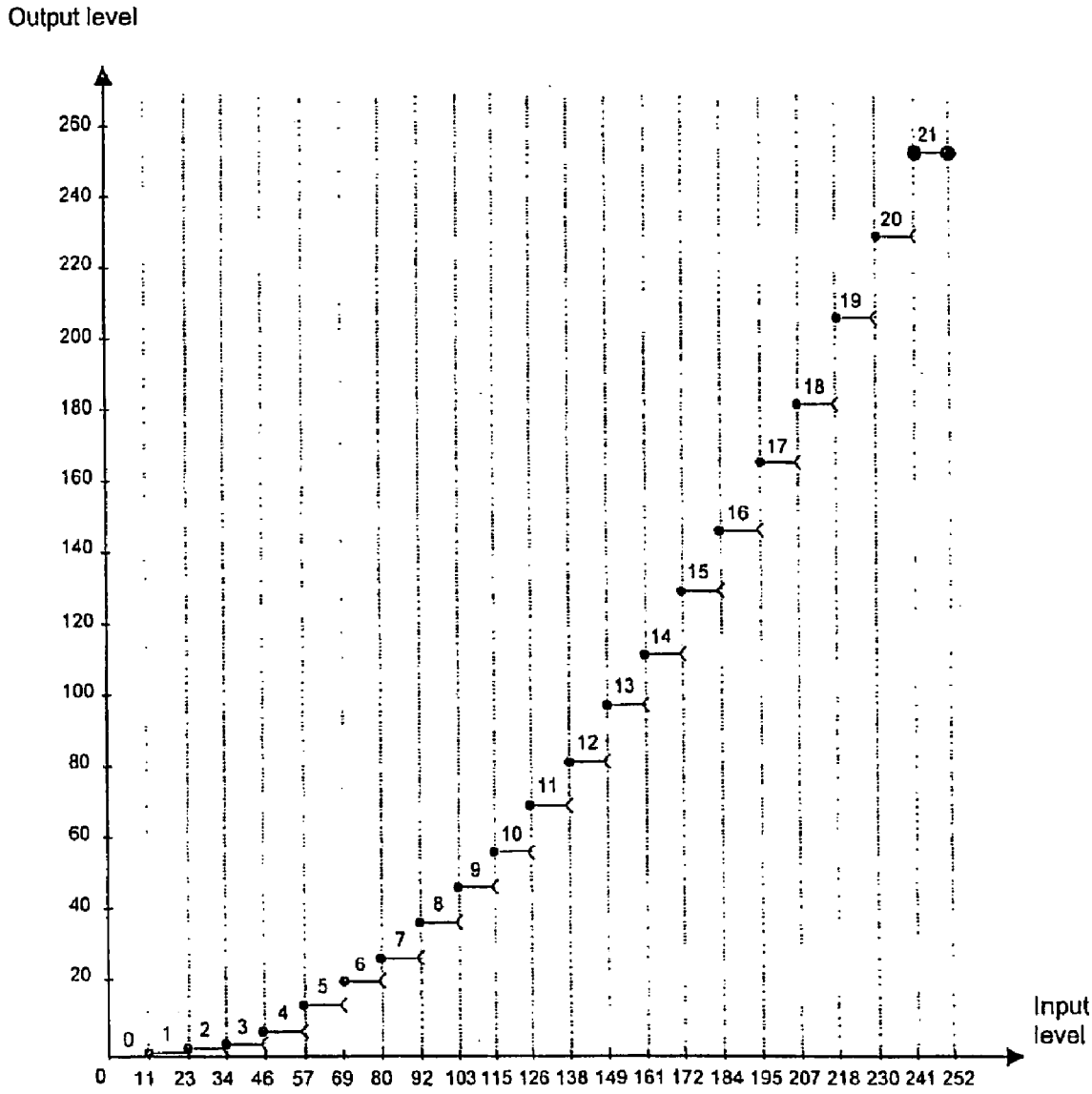
FIG. 11 shows a "stepwise" curve illustrating the gamma correction of the grey levels received by the PDP.

To make a gamma correction to the signal received by the PDP, a level code as illustrated in FIG. 11 is assigned to each input grey level of the PDP, by means of a look-up table, in order to correct for the linearity defects of the input video signal of the PDP and the input grey level is replaced with the grey level value associated with the level code assigned to this input grey level. For example, in FIG. 11, the code 0 corresponding to the grey level value 0 is assigned to the input grey level values between 0 and 11 (not inclusive), the code 1 corresponding to the grey level value 1 is assigned to the input grey level values between 11 and 23 (not inclusive), the code 2 corresponding to the grey level value 2 is assigned to the input grey level values between 23 and 34 (not inclusive), . . . and the code 21 corresponding to the 252 grey level value is assigned to the input grey level values between 241 and 252. The "stepwise" appearance of the curve is nonlinear. It is possible to modify the appearance of this curve by modifying the grey level value associated with each level code, for example by modifying the weights of the subscans.

Figure 12:
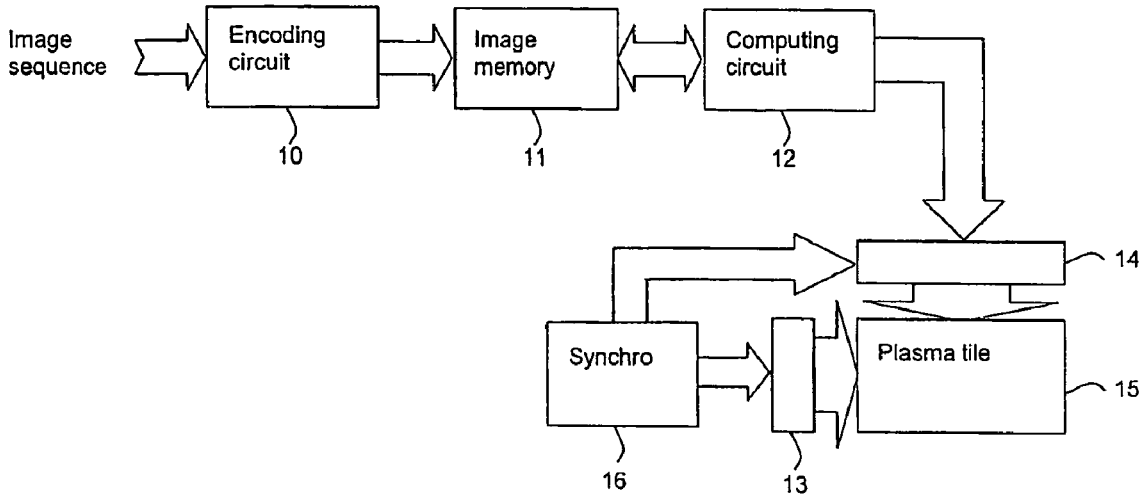
FIG. 12 shows an example of a device for implementing the method of the invention.

Very many structures are possible for implementing the method of the invention. One illustrative example is shown in FIG. 12. The images are firstly processed by an encoding circuit 10 which encodes the images according to the method of the invention. An image memory 11 receives the encoded images. The memory is sized so as to store at least three consecutive images, I−1, I and I+1, the image I+1 being stored while the image I is being processed using the image I−1. A computing circuit 12, for example a signal processor, calculates the movement vectors to be associated with the various pixels of the image in question and shifts the subscans as shown in FIG. 11, and delivers the turn-on signals to the row driver 13 and the column driver 14 of a plasma panel 15. A synchronization circuit 16 is provided for synchronizing the drivers 13 and 14. This structure is given merely by way of illustration.

In the present description, reference has been made to an arrangement of the subscans in which the weights are increasing then decreasing. It goes without saying that the invention also applies to an arrangement of the subscans whose weights are decreasing and then increasing, the change of state during the first subframe then corresponding to turning off the subscans and the change of state during the second subframe corresponding to turning them on.

The example described also refers to a plasma display panel. A person skilled in the art will readily understand that the invention applies to any type of digital display device. The term "digital display device" should be understood to mean a level of illumination operating in on/off mode, namely in the on state or in the off state.

The invention claimed is:

1. Method of displaying a video image on a display device, comprising a plurality of elementary cells, during a display frame, the display frame of a video image being composed of a plurality of periods called subscans during which each elementary cell is either in the on state or in the off state, each subscan having a weight proportional to its illumination period, wherein each display frame is divided into first and second subframes during which each cell changes state at most once, in each subframe said first and second subframes comprising approximately the same number of subscans, the subscans of the first subframe being arranged in a decreasing order of their weight and the subscans of the second subframe being arranged in a increasing order of their weights, and in that, for at least one transition from a lower grey level to the next upper grey level, a subscan which is in the on state for the lower grey level is in the off state for the next upper grey level.

2. Process according to claim 1, wherein, for each cell, the said first and second subframes comprise approximately the same number of subscans during which the said cell is in the on state.

3. Process according to claim 2, wherein the said first and second subframes comprise the same number of subscans.

4. Process according to claim 2, wherein, if the first subframe comprises N subscans during which the cell is in the on state, the second subframe comprises N−1 or N subscans during which the cell is in the on state, N being a natural integer greater than or equal to 1.

5. Process according to claim 2, wherein, if the first subframe comprises N subscans during which the cell is in the on state, the second subframe comprises N or N+1 subscans during which the cell is in the on state, N being a natural integer greater than or equal to zero.

6. Process according to claim 2, wherein, if the first subframe comprises N subscans during which the cell is in the on state, the second subframe comprises N−1, N or N+1 subscans during which the cell is in the on state, N being a natural interger greater than or equal to 1.

7. Process according to claim 2, wherein, if the first subframe comprises N subscans during which the cell is in the on state, the second subframe comprises N−2, N−1, N, N+1 or N+2 subscans during which the cell is in the on state, N being a natural integer greater than or equal to 2.

8. Method according to claim 1, wherein the movement of the current video image with respect to the preceeding video image is estimated so as to generate a movement vector for each pixel of the video image and, for each pixel of the current video image, the subscans of the second subframe are displaced by an amount equal to half of the movement vector generated.

9. Plasma display panel, wherein it includes a device that implements the display method of claim 1.

* * * * *